United States Patent [19]

Reba

[11] 4,342,413

[45] Aug. 3, 1982

[54] TURNING BAR FOR MOVING WEB

[75] Inventor: Imants Reba, Vancouver, Mass.

[73] Assignee: Crown Zellerbach Corporation, San Francisco, Calif.

[21] Appl. No.: 231,656

[22] Filed: Feb. 5, 1981

[51] Int. Cl.[3] ..... B65H 17/28; B65H 17/32

[52] U.S. Cl. ..... 226/97; 226/197; 226/7

[58] Field of Search ..... 226/7, 95, 97, 197; 34/151–156

[56] References Cited

U.S. PATENT DOCUMENTS

| | | | |
|---|---|---|---|
| 3,498,515 | 3/1970 | Johnson . | |
| 3,567,093 | 3/1971 | Johnson | 226/97 |
| 3,679,116 | 7/1972 | Hamlin et al. | 226/197 |
| 4,043,495 | 8/1977 | Sander | 226/197 |
| 4,136,808 | 1/1979 | Reba | 226/97 |
| 4,186,860 | 2/1980 | Reba | 226/91 |
| 4,197,972 | 4/1980 | Daane | 226/97 |

*Primary Examiner*—Leonard D. Christian
*Attorney, Agent, or Firm*—Thomas R. Lampe

[57] ABSTRACT

Apparatus for providing an air cushion to support web material during turning thereof and including means defining two plenums providing a flow path for pressurized gas prior to the gas exiting from a slit adjacent a generally curved fluid flow attachment surface. The dual plenum arrangement results in an even air distribution at the location of the slit thus contributing to web stability and control as the web floats on a cushion of air comprised of the pressurized air and ambient air along the generally curved fluid flow attachment surface due to the Coanda effect.

12 Claims, 4 Drawing Figures

TURNING BAR FOR MOVING WEB

BACKGROUND OF THE INVENTION

1. Field of the Invention

This invention relates to a bar for supporting a movable web as the web is transported and redirected from a first direction of movement to a second direction of movement, and in particular, to a turning bar which generates an air cushion to support, stabilize and remove wrinkles from the web as it makes the turn.

2. Description of the Prior Art

A variety of systems and devices are known in the prior art for developing an air cushion to support a moving web as the web changes direction. The purpose of such air cushion is to support the web free of engagement with a solid member during web transport to prevent damage and wear to the web.

Examples of such prior art devices are disclosed in Johnson U.S. Pat. No. 3,567,093, issued Mar. 2, 1971, Johnson U.S. Pat. No. 3,498,515, issued Mar. 3, 1970, Hamlin et al. U.S. Pat. No. 3,679,116, issued July 25, 1972, Sander U.S. Pat. No. 4,043,495, issued Aug. 23, 1977, Reba U.S. Pat. No. 4,136,808, issued Jan. 30, 1979, and Daane U.S. Pat. No. 4,197,972, issued Apr. 15, 1980.

Many of the prior art turning bar devices employ a plurality of apertures or slits in pressurized turning bar housings through which pressurized air passes and provides a direct support for the web during transport. It will be appreciated that devices of this nature use inordinately large amounts of pressurized air to accomplish the purpose of web support and are consequently inefficient and expensive to operate. In addition, such devices, due to uneven air distribution found at the turning bar surface, can cause wrinkling and other deformations to occur in the web. Prior art devices are also often characterized by even greater inefficiencies when operating at high speeds.

In the above-noted U.S. Pat. No. 4,197,972, issued to Daane, a turning bar device is illustrated which utilizes the Coanda effect to provide an air cushion for a web. When utilizing the Coanda effect ambient air is entrained to provide a portion of the web cushion and thus operating efficiencies are attained. The present invention also relates to a turning bar arrangement employing the Coanda effect to provide an air cushion. The present invention, however, employs a specific arrangement for bringing the Coanda effect into play, an arrangement that is specifically adapted to ensure even air distribution to the Coanda nozzle forming a component of the turning bar. Even air distribution is important to maintain proper web stability and control as the web makes the turn about the bar. In the present invention web control can be readily accomplished without the necessity of employing air nozzles disposed along the edges of web travel as is the case in Daane to eliminate side drift or lateral tracking instability of the web as well as to ensure predetermined desired spacing of the web with respect to the turning bar.

Another feature of the present invention resides in the employment in the turning bar of means to crown the web as it makes the turn, thus removing wrinkles therefrom and contributing to web stabilization. The invention is particularly useful with wet coated webs wherein contact could disrupt or cause defects in the coating.

BRIEF SUMMARY OF THE INVENTION

Apparatus constructed according to the teachings of the present invention includes an elongated first plenum defining means having inlet and outlet openings therein, an elongated housing surrounding and spaced from the elongated first plenum defining means to define a second plenum therewith in fluid flow communication with the first plenum through the outlet means, and means defining a curved fluid flow attachment surface positioned immediately adjacent to a slit formed in the housing in communication with said second plenum. The dual plenum arrangement of the present invention is so constructed as to allow even distribution of air to the housing outlet slit thereby providing a precisely controlled air cushion for the web being turned about the apparatus. The air cushion is comprised of the pressurized air passing through the housing restricted outlet slit and ambient air entrained thereby. The air cushion attaches itself to the curved fluid flow attachment surface due to the Coanda effect. Means is preferably provided to vary slit width along the length thereof to provide more pressurized air at the center of the web than at the edges thereof, thus serving to crown the web.

DETAILED DESCRIPTION

Figure 1:
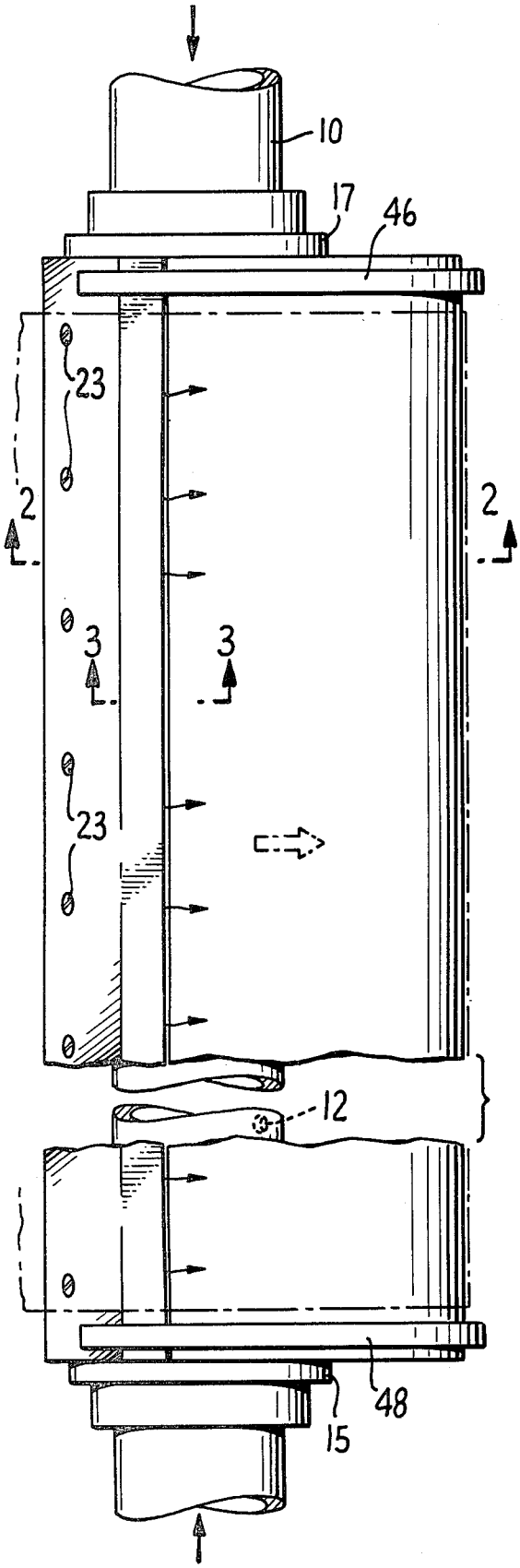
FIG. 1 is a plan view of the preferred form of apparatus constructed in accordance with the teachings of the present invention.
Figure 2:
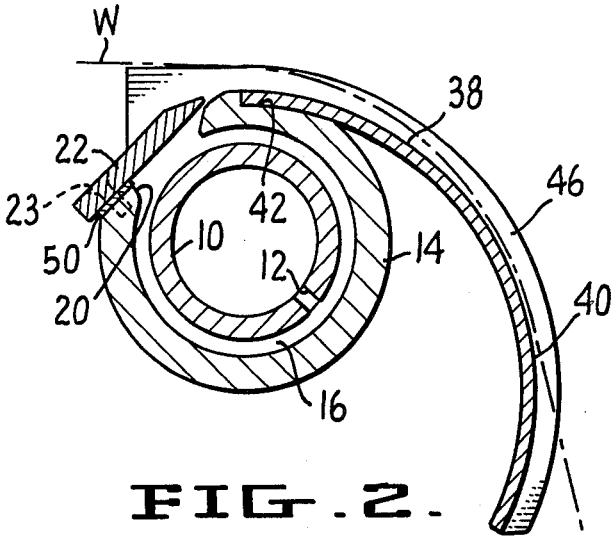
FIG. 2 is a cross sectional view taken along line 2—2 in FIG. 1.
Figure 3:
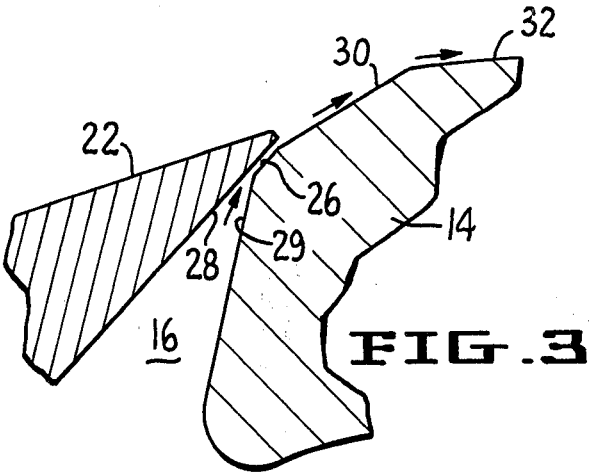
FIG. 3 is an enlarged detail view of the means defining a restricted opening in the apparatus housing and related structure as taken along line 3—3 in FIG. 1.

In FIGS. 1-3 apparatus constructed in accordance with the teachings of the present invention includes first plenum defining means 10 in the form of an elongated conduit formed of any suitable material such as aluminum. At one or both outer ends thereof means 10 is supported by a suitable housing (not shown). At at least one end thereof, and preferably at both ends thereof, the interior or plenum defined by means 10 is selectively placed in communication with any suitable source of pressurized air such as an air compressor (not shown). Pressurized air entering the first plenum defining means 10 will be caused to exit therefrom through a plurality of air distribution slots or apertures 12 formed along the length of means 10.

Surrounding elongated first plenum defining means 10 and spaced therefrom is a housing 14 which is also preferably in the general shape of a conduit formed of aluminum or other suitable material. Housing 14 and first plenum defining means 10 are commonly connected by end caps 15 and 17 and cooperate to form a generally cylinderically shaped second plenum 16 therebetween. Apertures 12 provide fluid flow communication between the first plenum and second plenum 16.

As may be seen most clearly with reference to FIG. 2, housing 14 forms a gap 20 near the upper end thereof substantially diametrically opposite to the locations of apertures 12 in the elongated first plenum defining means 10. Gap 20 extends along the full length of housing 14. A plate 22 is secured to housing 14 as by means of screws 23 or any other suitable expedient to generally cover the gap along its length. The free end of plate 22 projects over a first planar surface 26 formed on housing 14 as shown in detail in FIG. 3. The bottom of plate 22 forms a second planar surface 28 which is parallel to first planar surface 26 and defines an elongated slit therewith. Second planar surface 28 converges with a third planar surface 29 formed on housing 14 at a predetermined angle which may be in the order of 30 degrees for example.

It will be appreciated that pressurized air in second plenum 16 will exit from the slit defined by planar surface 26 and 28 as a thin high speed gaseous flow at an acute angle with respect to the direction of a web W as the web passes over the slit in a predetermined first direction of movement (generally horizontal direction in the drawing). After exiting from the slit the pressurized gas will attach itself to a generally curved fluid flow attachment surface defined in part by fourth and fifth planar surfaces 30 and 32 formed on housing 14. In a representative construction of the turning bar, surface 30 diverged from planar surfaces 26 and 28 an angle of 17 degrees and surface 32 by an angle of 40 degrees, although this may be varied as necessary. As shown in FIG. 2 planar surface 32 merges into and is contiguous with the outer curved surface 38 of curved deflection member 40 mounted in a recess 42 formed in housing 14. It will be appreciated that the pressurized gas passing through the slit and ambient air entrained thereby will attach to the generally curved surface as defined by surfaces 30, 32 and 38. The air cushion will direct the web from a predetermined first direction of movement shown at the upper left end of FIG. 2 to a second predetermined direction assumed by the web W at the location shown at the right side of FIG. 2 where the web exits from curved deflection member 40.

It should be noted that web W is brought into close proximity with the turning bar at a location downstream from the slit whereat the air cushion is moving substantially the same direction as the web. If web W were to approach the slit too closely it would be subjected to undesirable suction forces that would tend to pull the web downwardly. If desired, suitable adjustment mechanism (not shown) may be associated with the turning bar to enable an operator to "fine tune" positioning of the bar slit relative to the web to optimize results.

Lateral air loss from the cushion supporting web W is prevented by employing two sidewalls 46 and 48 along the edges of the generally curved fluid flow attachment surface. Additional control over the characteristics of the air cushion may be provided by employing a suitable means of varying the width of the slit along its length to establish a desired air flow profile. It has, for example, been found that by making the slit wider in the center than at the edges, more air cushioning in the middle of the web is obtained which creates cross machine spreading and improved guiding of the web. In essence, this provides for a crowning effect in the web whereby wrinkles will be removed. The turning bar may thus be used to accomplish the objectives of a far more expensive Mount Hope roll without contact with the web. Slit thickness variations may be accomplished through the use of any suitable expedient such as the employment of shims 50 or a screw adjustment mechanism of the type shown in my U.S. Pat. No. 4,186,860, issued Feb. 5, 1980.

As indicated above it is highly important that pressurized air be evenly distributed in the system at the point where it is introduced into the slit. The dual plenum arrangement of the present system as described above serves to accomplish this. It will be appreciated that air exiting from apertures 12 divides into two segments as shown by the arrows in FIG. 2 and flows within the second plenum 16 until the vicinity of the gap 20 is reached. Such flow path tends to dampen out and even any flow anomalies that may have been created along the length of the system prior to passage of the pressurized air through the slit.

Figure 4:
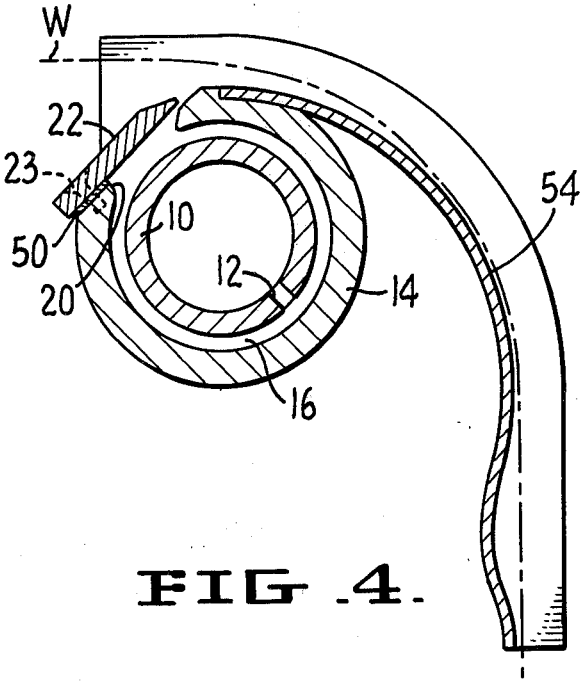
FIG. 4 is a view similar to that of FIG. 2 but illustrating an alternative embodiment.

FIG. 4 shows an alternative embodiment of the present invention. This embodiment differs from that shown in FIGS. 1–3 only by virtue of the fact that it employs a cambered curved deflection member 54. It has been found that such cambered configuration can be used to further improve web turning efficiency, i.e. the extent of arc over which the web floats without contact, by virtue of the fact that air flow will be modified at the point of camber to hold the web W against the deflection member over a longer length. This occurs because the Coanda effect causes the air cushion to bend inwardly at the location of camber.

I claim:

1. Apparatus for supporting web material as said web material is transported and redirected from a predetermined first direction of movement to a predetermined second direction of movement, said apparatus comprising:

elongated first plenum defining means having an inlet for the admission of pressurized gas into said first plenum and an outlet positioned along the length of said elongated first plenum defining means for allowing egress of said pressurized gas from said first plenum;

an elongated housing surrounding and spaced from said elongated first plenum defining means to define a second plenum therewith in fluid-flow communication with said first plenum through said outlet, said elongated housing at least partially defining a slit providing fluid-flow communication between said second plenum and the ambient atmosphere; and means defining a generally curved fluid flow attachment surface positioned immediately adjacent said slit whereby pressurized gas exiting from said slit will attach itself to said generally curved fluid flow attachment surface due to the Coanda effect and provide along with ambient air entrained by said exiting gas a gaseous support cushion for said web during transport and redirection thereof.

2. The apparatus of claim 1 additionally comprising walls positioned along the edges of said generally curved fluid flow attachment surface defining means and extending from said slit whereby lateral loss from said gaseous support cushion is diminished.

3. The apparatus of claim 1 wherein said generally curved fluid flow attachment surface defining means at least partially comprises a curved plate affixed to said elongated housing.

4. The apparatus of claim 1 wherein said curved fluid flow attachment surface defining means at least partially comprises said elongated housing.

5. The apparatus of claim 1 wherein said elongated first plenum defining means comprises a conduit having a generally circular cross-section and wherein said outlet comprises a plurality of spaced apertures formed in said conduit along the length thereof.

6. The apparatus of claim 1 wherein said slit extends longitudinally along said elongated housing.

7. The apparatus of claim 6 wherein said slit is defined by two parallel planar slit defining surfaces, at least one of said surfaces formed on said elongated housing, said surfaces defining an acute angle with said first direction of web movement.

8. The apparatus of claim 6 additionally comprising means for variably adjusting the width of said slit along the length thereof.

9. The apparatus of claim 1 further comprising end caps extending from said elongated first plenum defining means over said second plenum and said elongated housing.

10. The apparatus of claim 1 wherein said elongated first plenum defining means and said elongated housing each comprises conduits, said conduits being disposed substantially concentrically with respect to each other.

11. The apparatus of claim 1 wherein said slit and said outlet are disposed substantially in opposition to each other.

12. The apparatus of claim 11 wherein said second plenum defines a generally cylindrically-shaped fluid flow path between said slit and said outlet.

* * * * *